United States Patent [19]

Tager

[11] Patent Number: 4,995,120

[45] Date of Patent: Feb. 26, 1991

[54] TOILET SEAT CLOSING DEVICE

[76] Inventor: Benny L. Tager, Rte. 5, Box 7013, Quinlan, Tex. 75474

[21] Appl. No.: 394,576

[22] Filed: Aug. 16, 1989

[51] Int. Cl.[5] ..... A47K 13/10

[52] U.S. Cl. ..... 4/251; 4/236; 4/240; 4/253

[58] Field of Search ..... 4/251, 253, 254, DIG. 3, 4/250, 240, 248, 236, 661

[56] References Cited

U.S. PATENT DOCUMENTS

| | | | |
|---|---|---|---|
| 2,200,687 | 5/1940 | Bercot | 4/249 |
| 2,219,044 | 10/1940 | Horr | 4/233 |
| 2,772,422 | 12/1956 | Knudsen | 4/251 |
| 3,316,561 | 5/1967 | Newkirk | 4/251 |
| 4,055,864 | 11/1977 | Liu et al. | 4/DIG. 3 |
| 4,338,690 | 7/1982 | Hsieh et al. | 4/251 |
| 4,551,866 | 11/1985 | Hibbs | 4/251 |
| 4,766,619 | 8/1988 | Takeda | 4/251 |
| 4,777,671 | 10/1988 | Kearns | 4/251 |

FOREIGN PATENT DOCUMENTS

| | | | |
|---|---|---|---|
| 337477 | 10/1989 | European Pat. Off. | 4/251 |

*Primary Examiner*—Henry K. Artis
*Attorney, Agent, or Firm*—Crutsinger & Booth

[57] ABSTRACT

A toilet seat closing device incorporating a reversible DC electric motor connected through a three position reversible ratchet clutch mechanism to the toilet seat. A control circuit incorporating a timer is set when the toilet seat is raised and is adapted to energize the electric motor at the expiration of a predetermined time interval for moving the toilet seat from the raised position to a lowered position.

12 Claims, 3 Drawing Sheets

TOILET SEAT CLOSING DEVICE

TECHNICAL FIELD

The invention relates to the field of toilet seat closing devices and in particular to a closing device incorporating a motor driven clutch which can be actuated for raising and lowering the toilet seat.

BACKGROUND OF INVENTION

Automatic toilet seat closing devices heretofore devised have incorporated rather complex structure and were difficult to clean for maintaining sanitary conditions. Further, the known structures generally either include a lifting mechanism or an automatic lowering mechanism but cannot be manipulated for selectively engaging the device for automatically lifting the toilet seat or lowering the toilet seat or automatically raising and lowering the toilet seat.

U.S. Pat. No. 2,200,687 discloses a toilet seat and cover which may be automatically closed under predetermined conditions after being shifted to a raised position. A pair of cushioning cylinders are employed for damping the fall of the seat and cover from a raised to a closed position.

U.S. Pat. No. 4,551,866 discloses apparatus for automatically returning a hinged toilet seat to the lowered horizontal position after use of a toilet as a urinal by a male. A piston which moves in an operating cylinder is linked by a lever mechanism to the toilet seat. Movement of the seat to the upper position actuates a biasing spring to urge the piston to return the seat to the lower position. The biased piston movement is retarded by operating fluid flowing through a port in the piston to delay closing until the male user is finished.

U.S. Pat. No. 2,772,422 discloses a lifting mechanism for toilet seats for automatically elevating the toilet seat after a predetermined time lag after each use so that a succeeding occupant may employ the toilet as a urinal without the necessity of manually elevating the seat.

U.S. Pat. No. 3,316,561 discloses an actuating mechanism for a toilet seat for raising the seat and providing for the automatic closure of the seat and lid after a predetermined length of time.

U.S. Pat. No. 2,219,044 discloses an electric driving motor for raising a toilet seat cover. A pedal is depressed for closing a switch to energize the motor for rotating the cover upwardly. When a load is applied to the seat of the toilet and then removed, a switch closes and a cam cylinder starts rotating to return the cover to its closed position.

A need exists for an apparatus for controlling the manipulation of a toilet seat which can be manipulated to cause the seat to be automatically lowered upon the expiration of a predetermined time after the seat has been raised manually or by an electric motor.

SUMMARY OF INVENTION

The toilet seat closing device disclosed herein incorporates a reversible low voltage direct current motor which is connected through a shiftable ratcheting clutch mechanism to a toilet seat. When the clutch is shifted to a central position, the drive shaft of the electric motor is connected directly to the toilet seat such that the motor can be employed for raising and lowering the toilet seat by manipulation of a switch connected to the motor. When the clutch is shifted in one direction the electric motor applies torque for lowering the seat after it has been manually raised. When the clutch is shifted in the opposite direction the motor can be used for raising the seat which can be lowered manually.

DESCRIPTION OF THE DRAWINGS

Drawings of a preferred embodiment of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
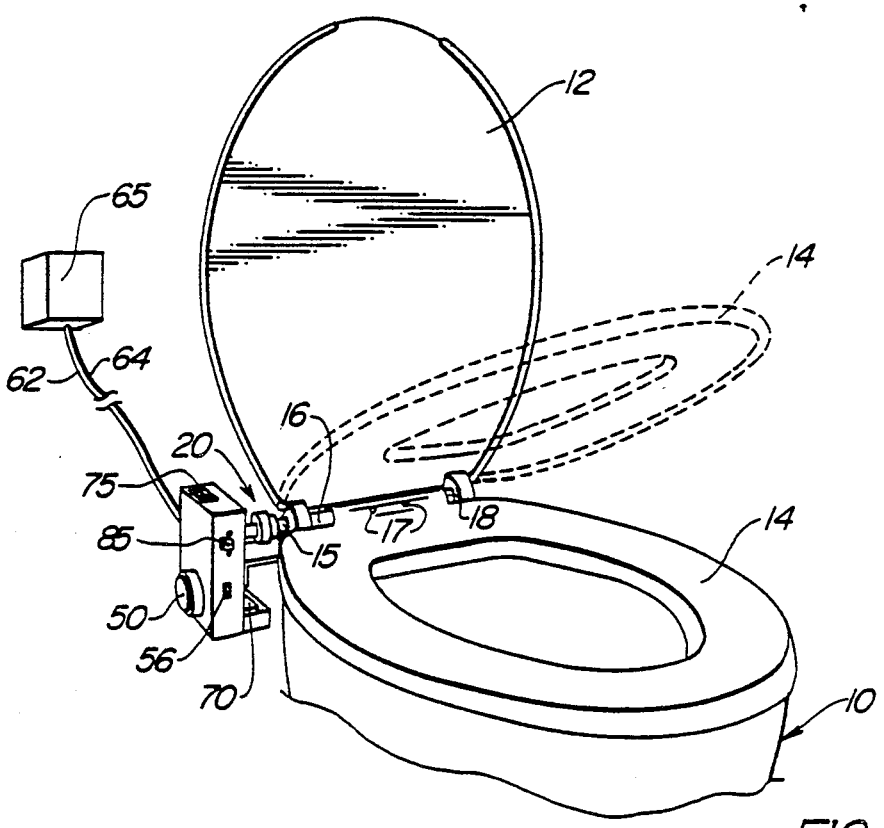
FIG. 1 is a perspective view of a toilet bowl having improved toilet seat closing device mounted thereon.

Referring to FIG. 1 of the drawing, the numeral 10 generally designates the bowl of a conventional toilet or water closet having a cover 12 and a seat 14. An actuating rod 15 is pivotally supported in hinge members 16 and 18 conventionally secured to the toilet bowl 10 by downwardly extending bolts (not shown) which extend through apertures formed in a rear ledge on bowl 10. The toilet bowl 10, cover 12 and seat 14 are of conventional design and form no part of the invention except in combination with the seat lifting mechanism.

One or more set screws or anchor pins 17 rigidly secure seat 14 to rod 15 for causing seat 14 and rod 15 to rotate as a unit about the axis of rod 15 which is rotatably mounted in hinges 16 and 18 secured to toilet bowl 10. Cover 12 is conventionally provided with a pair of perforated lugs having openings through which rod 15 extends. Cover 12 rotates freely about rod 15.

Figure 2:
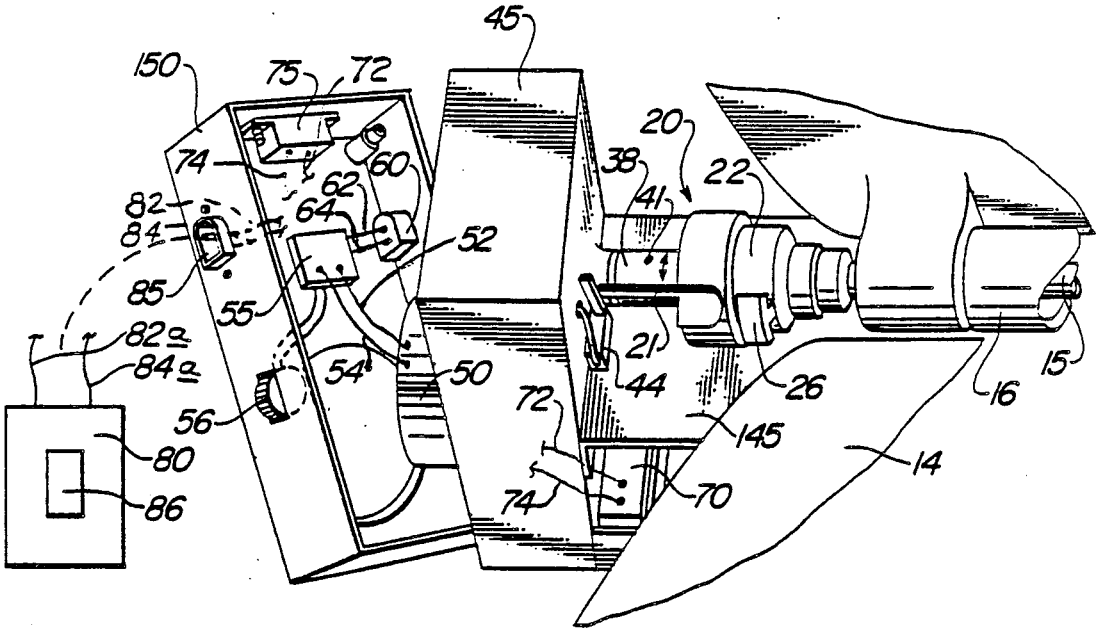
FIG. 2 is an enlarged perspective view of the toilet seat closing device, the cover being removed to more clearly illustrate details of construction.
Figure 3:
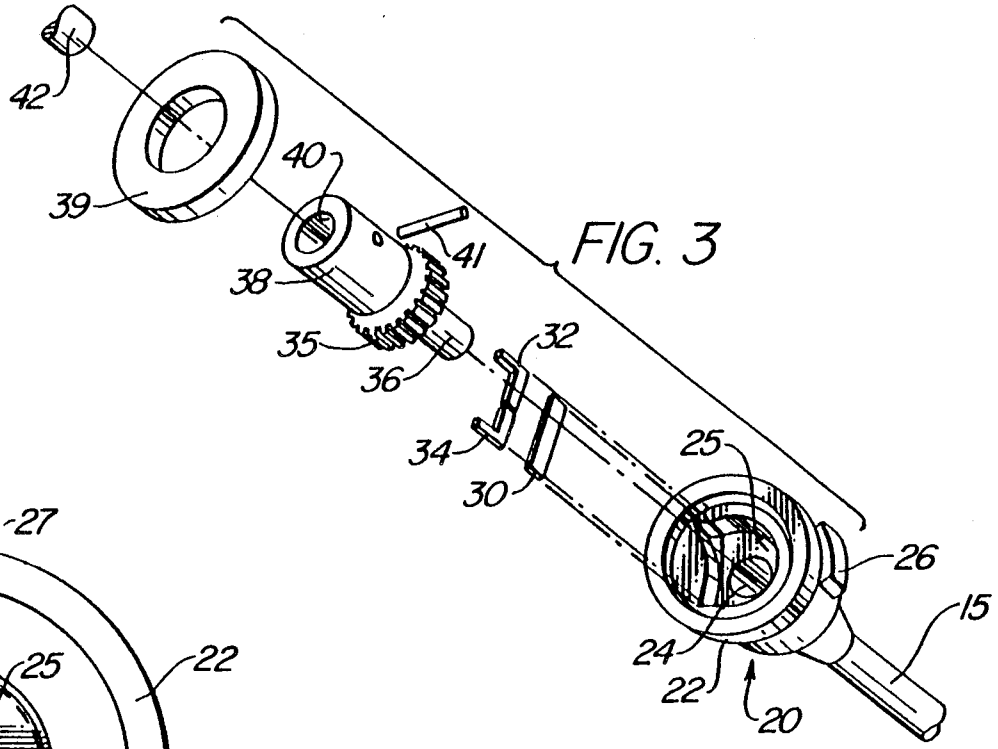
FIG. 3 is an exploded perspective view of the shiftable clutch.

As best illustrated in FIGS. 1 and 2 of the drawing, a clutch generally designated by the numeral 20 is mounted between the end of rod 15 and a gear box 45. Electrical control circuitry for an electric motor 50 is enclosed in a housing 150.

Clutch 20 is of conventional design and is of the type employed in reversible ratchet driver sets which are commercially available from several sources including Sears & Roebuck Company and Allied International. Clutch 20 is a three position ratcheting torque transmitting apparatus comprising a tubular body 22 having a cam 25 rotatably mounted in a hollow stepped interior. Cam 25 is rotatably mounted in a socket formed in body 22 by a shifting lever 26 extending through a slot 27 formed in the wall of the body. Cam 25 has a land 28 formed therein to engage dogs 32 and 34 which are resiliently urged into engagement therewith by a leaf spring 30.

A pinion 35 having a pivot pin 36 extending outwardly from one end thereof and a hollow tubular sleeve 38 extending outwardly from the opposite end thereof is telescopically received in the stepped hollow interior formed in tubular body 22 when pivot pin 36 is positioned in a central opening 24 in cam 25. Drive sleeve 38 extends through a central opening in bearing cap 39 which closes the open end of the passage formed in tubular housing 22.

Figure 4:
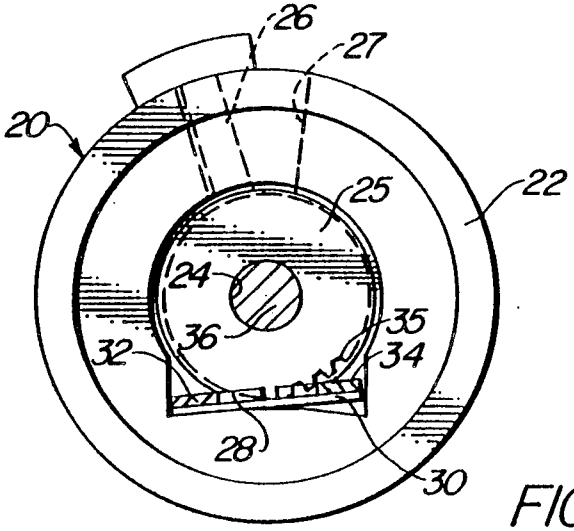
FIG. 4 is a cross-sectional view taken along line 4—4 of FIG. 2.

As illustrated in FIG. 4 of the drawing, when shifting lever 26 is actuated in one direction, dog 32 is moved out of engagement with teeth on pinion 35 while dog 34 is resiliently urged by spring 30 into engagement with teeth on pinion 35. When cam 25 is rotated to the position illustrated in FIG. 4 of the drawing, force is transmitted from pinion 35 through dog 34 to tubular housing 22, when pinion 35 is rotated in a counterclockwise direction. However, when pinion 35 is rotated in a clockwise direction as viewed in FIG. 4 of the drawing, spring 30 allows dog 34 to move downwardly and no substantial torque is transmitted between pinion 35 and housing 22.

When shifting lever 26 is rotated to a central position intermediate opposite edges of slot 27, both of the dogs 32 and 34 engage teeth on pinion 35 locking pinion 35 relative to tubular body 22. In this position torque is transmitted from pinion 35 to tubular body 22 when pinion 35 is rotated in either direction.

When shifting lever 26 is moved to the right as viewed in FIG. 4 of the drawing, cam 25 is rotated in a clockwise direction moving dog 34 out of engagement with teeth on pinion 35 while spring 30 urges dog 32 into engagement with teeth on pinion 35. In this position, rotation of pinion 35 in a clockwise direction will transmit torque to tubular body 22. However, rotation of pinion 35 in a counterclockwise direction will not transmit torque to body 22.

As hereinbefore explained, clutch 20 has been used heretofore for other applications and forms no part of my invention except in the combination described herein.

Tubular body 22 of clutch 20 is welded or otherwise rigidly secured to an end of actuating rod 15 such that rotation of housing 22 imparts rotation through rod 15 to toilet seat 14.

Drive sleeve 38 has a passage 40 formed therein to receive the end of a drive shaft 42 from a conventional gear reducer 45 having an input shaft driven by a direct current, for example, 9 volt electric motor 50. Gear reducer 45 and electric motor 50 are of conventional design and are preferably selected to rotate pinion 35 at a speed of, for example, about one RPM.

Motor 50 is connected through conductors 52 and 54 to timer means or time delay device 55 switch or potentiometer provided with a timer set switch 56 for establishing the period of time which must elapse before current is delivered through conductors 52 and 54 to motor 50 after a signal is delivered to timer 55.

Figure 5:
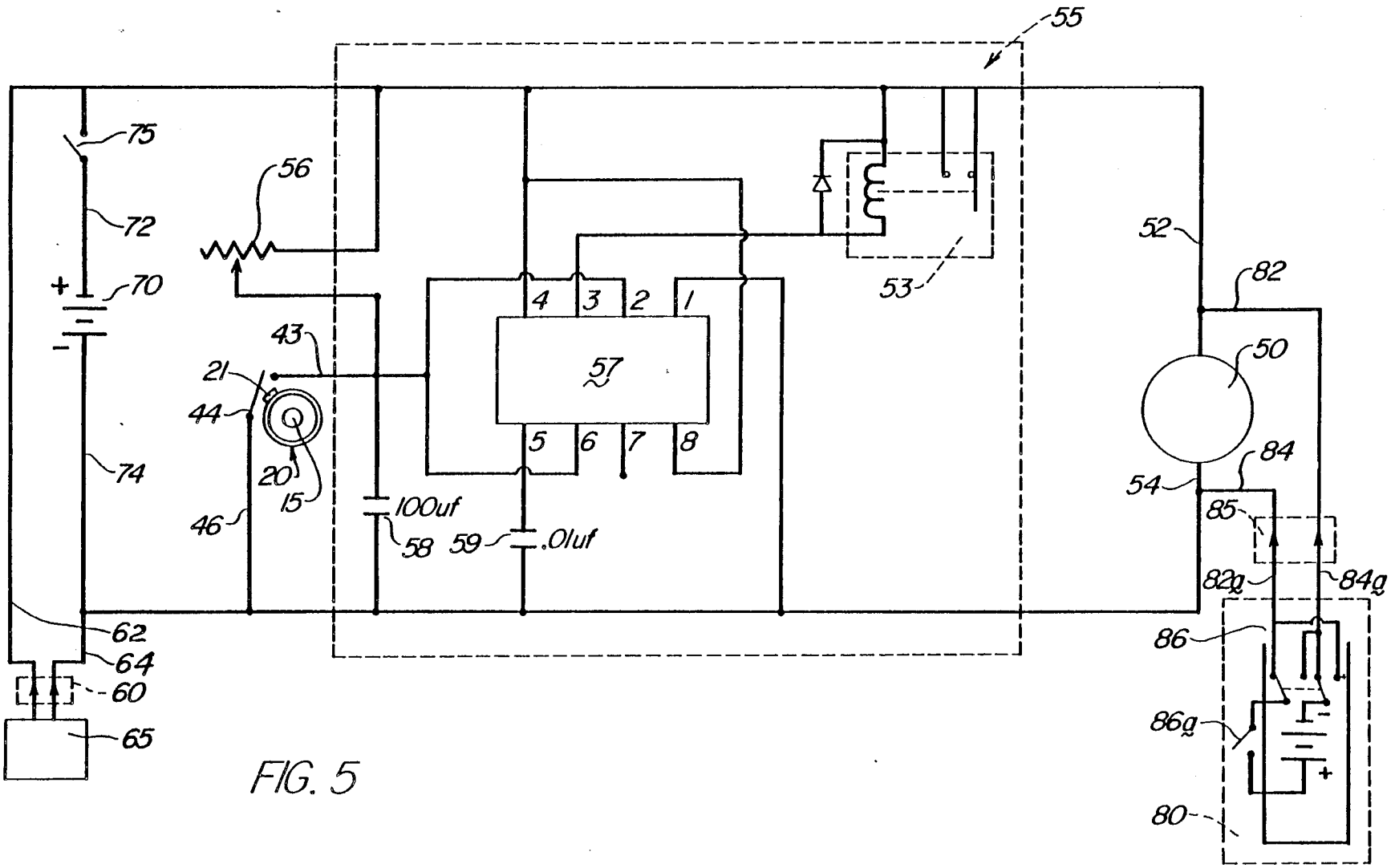
FIG. 5 is a wiring diagram of the electrical control circuit.

Time delay device 55 is diagrammatically illustrated in FIG. 5 of the drawing. Time delay device 55 comprises a relay 53 connected to the output terminal of an 8-pin integrated circuit timer 57 having a timing cycle controlled by a potentiometer 56 connected to the trigger and threshold terminals of the timer.

The integrated circuit timer 57 is of conventional design and is commercially available from Radio Shack, a division of Tandy Corporation, Catalog No. 276-1723, 555 Timer IC, 8-pin DIP. The terminals of the integrated circuit timer include a ground terminal 1, trigger terminal 2, output terminal 3, reset terminal 4, control voltage terminal 5, threshold terminal 6, discharge terminal 7 and $V_x$ terminal 8 connected as illustrated in FIG. 5 of the drawing.

As will be hereinafter more fully explained, a switch 44, actuated by a lever arm 21 secured to clutch 22 is connected through conductor 43 to the trigger and threshold terminals of integrated circuit timer 57. Switch 44 is preferably a leaf-type switch which is held open by lever 21 when the seat 14 is in the lower position and closes when seat 14 is raised.

As seat 14 moves from the lower position to the raised position, switch 44 closes. When switch 44 closes, relay 53 is actuated at the expiration of a predetermined time interval to energize motor 50 to slowly move seat 14 from the raised position toward the lowered position. As seat 14 reaches the lower position, rod 21 opens switch 44 to stop motor 50.

An electrical socket 60, of conventional design adapted to receive a plug from a conventional 9 volt transformer, is connected through conductors 62 and 64 to timer 55 to provide a primary power source. Transformer 65 converts 120 volt AC electrical power to form a 9 volt DC power supply.

A secondary power supply includes a 9 volt battery 70 having one terminal connected through a conductor 72 and switch 75 to conductor 62 of the primary power source and a second terminal connected through a conductor 74 to conductor 64 of the primary power source. Thus, it should be readily apparent that in the event of a power failure rendering the primary power source 60 inoperable, switch 75 can be closed for connecting the secondary power supply 70 to conductors 62 and 64 for thereby energizing timer 55 and driving motor 50.

Conductors 43 and 46 are connected to a normally closed switch 44 which is actuated by a lever 21 secured to the tubular body 22 of clutch 20. When seat 14 is raised, rod 15 and tubular body 22 are rotated thereby moving lever 21 out of engagement with microswitch 44 for delivering a signal to timer 55. At the expiration of the predetermined time interval established by setting timer switch 56, timer 55 will energize motor 50 imparting rotation from motor 50 through gear reducer 45, clutch 22 and rod 15 for slowly rotating seat 14 from a generally vertical position to the lowered position. When lever 21 engages microswitch 44 the circuit to electrical motor 50 will be opened and motor 50 will be de-energized.

A remote controlled device 80 is connectable through conductors 82*a* and 84*a* to a socket 85 which is connected directly through conductors 82 and 84 to the terminals of electric motor 50. Control device 80 comprises a tubular body having a battery mounted therein and a double pole double throw switch 86 mounted thereon. When switch 86 is moved to one position, the terminals of the battery mounted therein are connected through conductors 82 and 84 for rotating motor 50 in a first direction. When switch 86 is moved to a second position, motor 50 is driven in the opposite direction. An on-off switch 86*a* is provided to open and close the circuit from the batter to switch 86.

When shifting lever 26 of clutch 22 is moved to the locked central position, motor 50 is connected for driving rod 15 in either direction for raising and lowering seat 14. Thus, when remote control device 80 is to be employed for raising and lowering seat 14 shifting lever 26 of clutch 20 should be in the locked position.

Gear box 45 is a speed reducer secured by a bracket 145 to toilet bowl 10. Bracket 145 preferably comprises an elongated member having a pair of apertures formed therein through which the bolts on hinge members 16 and 18 extend to permit installation of the toilet seat closing device without requiring the use of any special tools or modification of either the toilet bowl or cover 12 or seat 14, except for forming one or more openings for receiving pins 17 which secure seat 14 to rod 15.

From the foregoing it should be readily apparent that motor 50 and speed reducer 45 having an output shaft 42 are connected through the reversible three position ratcheting clutch 20 to rod 15 which is rigidly secured to seat 14. Timer 55 is connected to a primary power source 60 and is connected through switch 75 to a secondary power source 70 which can be used in the event of a power failure from the primary power source 60.

The remote control device is an optional remote power supply which overrides both the primary and secondary power sources. However, it will be appreciated that remote control device 80 bypasses switch 44 and timer 55. Thus, switch 86 must be manipulated for turning motor 50 on and off for moving seat 14 between the upper and lower positions since the timer circuit is bypassed by the remote control circuitry.

Timer 55 can be set to any desired time interval, for example, between one second and three minutes. When seat 14 is raised manually, rod 15 and tubular body 22 of clutch 20 rotate moving lever 21 away from microswitch 44 to thereby begin a time delay period established by timer switch 56. At the expiration of the predetermined elapsed time period, motor 50 will be energized imparting rotation through drive shaft 42, clutch 20 and rod 15 to move seat 14 toward the lowered position. The rate at which seat 14 is lowered is equal to the speed of output shaft 42 causing the seat 14 to be lowered slowly. If the seat is stopped and manually moved upwardly before it reaches the lowered position, motor 50 will remain energized until lever 21 engages switch 44 thereby opening the circuit to motor 50. After switch 44 has been actuated, motor 50 will remain off until seat 14 is manually raised to turn on the timer and to initiate another time delay cycle.

A pin 41 extends through an opening in sleeve 38 into an opening in shaft 42. Pin 41 can be removed if it is deemed expedient to do so to facilitate cleaning the toilet. When pin 41 is removed, seat 14 may be moved up and down manually.

Other and further embodiments of the invention may be devised without departing from the spirit and scope of the appending claims.

Having described the invention, it is claimed:

1. A toilet seat connectable to a toilet bowl comprising: a toilet seat; means pivotally securing said toilet seat to a toilet bowl, said means being rotatable to move said toilet seat from a generally horizontal plane to a generally vertical plane; a motor; ratchet means drivingly connecting said motor to said toilet seat, said ratchet means being adapted to permit said toilet seat to be rotated manually from a generally horizontal plane to a generally vertical plane; and timer means associated with said motor to energize said motor to move said toilet seat from a vertical plane toward a horizontal plane upon expiration of a predetermined time period after said seat has been raised.

2. A toilet seat connectable to a toilet bowl comprising: an electric motor; a gear reducer; means connecting said motor to said gear reducer; a one way clutch having an input and an output; means connecting the input of said one way clutch to said gear reducer; a toilet seat; means connecting the output of said one way clutch to said toilet seat; and control means connected between said motor and said toilet seat, said control means being adapted to energize said motor at the expiration of a predetermined time interval after said toilet seat has been moved from a generally horizontal plane to a generally vertical plane such that said motor moves said toilet seat from the generally vertical plane to the generally horizontal plane.

3. A toilet seat according to claim 2, said control means comprising a switch; means secured to said toilet seat to actuate said switch upon movement of said toilet seat; and time delay means associated with said switch, said time delay means being adapted to energize said motor at the expiration of a predetermined time interval after said switch has been actuated and to de-energize said motor when said toilet seat moves to a lowered position.

4. A toilet seat according to claim 3, with the addition of a primary source of electricity connected to said timer and a secondary source of electricity connected through a second switch to said timer, said second switch being actuatable to activate said secondary source of electricity.

5. A toilet seat according to claim 4, with the addition of a remote source of electricity, said remote source of electricity including a three position switch connectable to said motor, said three position switch being adapted to deliver electrical current for driving said motor in opposite directions.

6. A toilet seat according to claim 5, with the addition of means for adjusting the time interval of the time delay means.

7. A toilet seat connectable to a toilet bowl comprising: a toilet seat; a rod secured to said toilet seat; means pivotally securing said rod to a toilet bowl, said rod being rotatable to move said toilet seat from a generally horizontal plane to a generally vertical plane; a motor; ratchet means connecting said motor to said rod, said ratchet means being adapted to permit said toilet seat to be rotated manually from a generally horizontal plane to a generally vertical plane; and timer means associated with said motor to energize said motor to move said toilet seat from a vertical plane toward a horizontal plane upon expiration of a predetermined time period after said seat has been raised.

8. A toilet seat according to claim 7, said ratchet means comprising: a three position reversible ratcheting clutch.

9. A toilet seat connectable to a toilet bowl comprising: a toilet seat; a primary electrical power source; means timer; means connecting said primary power source to said timer means; a rod secured to said toilet seat; means pivotally securing said rod to a toilet bowl, said rod being rotatable to move said toilet seat from a generally horizontal plane to a generally vertical plane; a motor; means connecting said timer means through switch means to said motor; to move said toilet seat upon expiration of a predetermined time period; means operably connected to said rod for actuating said switch means upon movement of said toilet seat; and ratchet means connecting said motor to said rod, said ratchet means being adapted to permit said toilet seat to be rotated manually from a generally horizontal plane to a generally vertical plane.

10. A toilet seat according to claim 9, with the addition of a secondary electrical power supply; and switch means connected between said timer and said secondary electrical power supply, said switch means being actuatable to energize said secondary electrical power supply.

11. A toilet seat connectable to a toilet bowl comprising: a toilet seat; a primary power supply a remove power supply; a rod secured to said toilet seat; means pivotally securing said rod to a toilet bowl, said rod being rotatable to move said toilet seat from a generally horizontal plane to a generally vertical plane; a motor; means connecting said primary power supply and said remote power supply to said motor, said remote power supply being adapted for driving said motor in opposite directions to rotate said rod in opposite directions to rotate said seat between generally horizontal and vertical planes in the event of failure of said primary power source; and ratchet means connecting said motor to said rod, said ratchet means being adapted to permit said toilet seat to be rotated manually from a generally horizontal plane to a generally vertical plane.

12. A toilet seat connected to a toilet bowl comprising: a toilet seat; means movably securing said toilet seat to a toilet bowl such that said toilet seat is movable from a generally horizontal plane to a generally vertical plane; an electric motor; a clutch having an input and an output; means connecting said electric motor to the input of said clutch; means connecting the output of said clutch to said toilet seat; and timer means associated with said electric motor to energize said motor to move said toilet seat between said generally vertical plane and said generally horizontal plane upon expiration of a predetermined time period after said toilet seat has been moved between said horizontal and vertical planes.

* * * * *

UNITED STATES PATENT AND TRADEMARK OFFICE

CERTIFICATE OF CORRECTION

PATENT NO. : 4,995,120

DATED : February 26, 1991

INVENTOR(S) : Benny L. Tager

It is certified that error appears in the above-identified patent and that said Letters Patent is hereby corrected as shown below:

Column 6, line 47, change "means timer" to read --timer means--

Column 6, line 67, change "remove" to read -- remote --

Signed and Sealed this

Twenty-third Day of June, 1992

*Attest:*

DOUGLAS B. COMER

*Attesting Officer*

*Acting Commissioner of Patents and Trademarks*